US011655951B2

(12) United States Patent
Lee et al.

(10) Patent No.: US 11,655,951 B2
(45) Date of Patent: May 23, 2023

(54) LAMP FOR VEHICLE

(71) Applicant: SL Corporation, Daegu (KR)

(72) Inventors: Kyung Su Lee, Gyeongsan-si (KR); Woo Yeong Son, Gyeongsan-si (KR); Ji Ho Hong, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 17/477,748

(22) Filed: Sep. 17, 2021

(65) Prior Publication Data

US 2022/0099265 A1 Mar. 31, 2022

(30) Foreign Application Priority Data

Sep. 29, 2020 (KR) ..... 10-2020-0127573

(51) Int. Cl.
*F21S 41/25* (2018.01)
*F21S 41/33* (2018.01)
*F21S 41/40* (2018.01)

(52) U.S. Cl.
CPC ..... *F21S 41/25* (2018.01); *F21S 41/336* (2018.01); *F21S 41/40* (2018.01)

(58) Field of Classification Search
None
See application file for complete search history.

(56) References Cited

U.S. PATENT DOCUMENTS

| | | | | |
|---|---|---|---|---|
| 3,393,034 | A * | 7/1968 | Senzo | F21S 11/00 359/593 |
| 2014/0328071 | A1* | 11/2014 | Son | F21S 41/285 362/464 |
| 2015/0109773 | A1* | 4/2015 | Li | F21V 5/007 362/231 |
| 2016/0040854 | A1* | 2/2016 | Zhang | F21V 14/06 257/89 |
| 2017/0292671 | A1* | 10/2017 | Gousset-Rousseau | F21S 41/285 |
| 2018/0106445 | A1* | 4/2018 | Okubo | F21S 41/265 |
| 2018/0216794 | A1* | 8/2018 | Marchal | B60Q 1/14 |
| 2019/0072253 | A1* | 3/2019 | Mouri | F21S 41/148 |
| 2019/0162382 | A1* | 5/2019 | Kang | F21S 41/365 |

* cited by examiner

*Primary Examiner* — Elmito Breval
(74) *Attorney, Agent, or Firm* — United One Law Group LLC; Kongsik Kim; Jhongwoo Peck

(57) ABSTRACT

Provided is a lamp for a vehicle to prevent light efficiency from being deteriorated while being embodied in a slim form factor. The lamp for a vehicle includes a light emission portion to generate light; a first optical portion disposed in front of the light emission portion to allow the light generated from the light emission portion to be incident thereto; and a second optical portion disposed between the light emission portion and the first optical portion. The second optical portion refracts the light in a direction different from a light refracting direction of the first optical portion.

16 Claims, 11 Drawing Sheets

LAMP FOR VEHICLE

CROSS-REFERENCE TO RELATED APPLICATION

This application claims priority to Korean Patent Application No. 10-2020-0127573 filed on Sep. 29, 2020, which application is herein incorporated by reference in its entirety.

BACKGROUND

1. Technical Field

The present disclosure relates to a lamp for a vehicle, and more particularly, to a lamp for a vehicle that may prevent light efficiency from being deteriorated while embodying a slim form factor.

2. Description of the Related Art

Generally, a vehicle is equipped with various lamps having an illumination function for more easily recognizing an object positioned in the vicinity of the vehicle during low light conditions (e.g., nighttime driving), and a signaling function for informing a nearby vehicle or pedestrian of a driving state of the vehicle. Installation criteria and specifications for the lamps for a vehicle are regulated by law so that each lamp may adequately perform its function.

For example, a main purpose of a head lamp and a fog lamp is the illumination function, and a main purpose of a turn-signal lamp, a tail lamp, a brake lamp, or the like is the signaling function.

The lamp for a vehicle includes a light source as well as a lens configured to form a beam pattern suitable for functions of the lamp for a vehicle by irradiating light generated from the light source to the outside, and a lamp image is formed by the light irradiated to the outside through the lens. The light source generates light having a predetermined light irradiation angle with respect to a light axis, and the lens is formed to have a size that allows the light generated from the light source to be incident thereto with as little loss as possible.

While the lamp for a vehicle has traditionally been only a means for an illumination function and a signaling function, the significance of the lamp has been recently increased in view of design. That is, in addition to a functional aspect of helping a driver to safely drive a vehicle by ensuring the driver's visibility, which is a basic role of the lamp for a vehicle, an aesthetic aspect through design improvement, perceived by a consumer, makes a significant influence on the consumer's decision in buying a vehicle.

To this end, studies for improving an exterior design by allowing a lamp for a vehicle to have a slimmer form factor have been actively ongoing. However, when a size of a lens is reduced to embody a slim form factor, light loss increases due to the light failing to enter the lens among lights generated from the light source, whereby light efficiency may be deteriorated.

Therefore, a method for preventing light efficiency from being deteriorated while embodying a slim form factor has been required.

SUMMARY

The present disclosure has been devised to solve the above-mentioned problems, and an object of the present disclosure is to provide a lamp for a vehicle, which may prevent light efficiency from being deteriorated while embodying a slim form factor by using a plurality of lenses that refract light in different directions.

Another object of the present disclosure is to provide a lamp for a vehicle, which may emit parallel light even in the case that both sides of at least one of a plurality of lenses are formed to be asymmetric to each other in at least one direction.

The objects of the present disclosure are not limited to those mentioned above, and additional objects of the present disclosure, which are not mentioned herein, will be clearly understood by those skilled in the art from the following description of the present disclosure.

According to an aspect of the present disclosure, a lamp for a vehicle may include a light emission portion to generate light; a first optical portion disposed in front of the light emission portion to allow the light generated from the light emission portion to be incident thereto; and a second optical portion disposed between the light emission portion and the first optical portion, the second optical portion configured to refract the light in a direction different from a light refracting direction of the first optical portion.

The second optical portion may refract the light toward a same side as the light refracting direction of the first optical portion. The second optical portion may refract the light toward an opposite side of the light refracting direction of the first optical portion. The second optical portion may refract the light at a refractive angle different from a refractive angle of the first optical portion.

Further, an emission surface of the first optical portion may form a portion of a contour of an exterior of the vehicle.

Both sides of the emission surface of the first optical portion may be formed to be asymmetrical to each other along at least one direction with respect to a center line that passes through a center of the first optical portion in a front and back direction.

A rear focal point of the first optical portion may be formed at a position spaced apart from the center line by a predetermined interval.

Both sides of at least one of an incident surface of the first optical portion, an incident surface of the second optical portion, or an emission surface of the second optical portion may be formed to be asymmetrical to each other along at least one direction with respect to the center line to allow the light to be emitted from the first optical portion in a direction substantially parallel with the center line. Both sides of at least one of an incident surface of the first optical portion, an incident surface of the second optical portion, or an emission surface of the second optical portion may be different from one another in terms of at least one of their forming angles or curvatures along at least one direction with respect to the center line.

The second optical portion may allow the light directed to outside of the incident surface of the first optical portion to be refracted and incident to the incident surface of the first optical portion.

A shield portion may be further provided for shielding at least a portion of the light proceeding from the light emission portion to the second optical portion.

The shield portion may include a reflective surface formed on a surface for shielding at least a portion of the light generated from the light emission portion to reflect the shielded light toward the first optical portion. The reflective surface may be formed such that a rear end thereof is spaced apart farther from the center line that passes through the center of the first optical portion than a front end thereof.

The light emission portion may include a first light source portion disposed above the shield portion, and a second light source portion disposed below the shield portion. Further, a reflective surface configured to reflect at least a portion of the light shielded by the shield portion toward the first optical portion may be formed on at least one of an upper surface or a lower surface of the shield portion.

The aforementioned lamp for a vehicle of the present disclosure may provide one or more advantageous effects as follows. Even in the case that a first optical portion and a second optical portion, which are disposed in a front and back direction, refract light in different directions, and an emission surface of the first optical portion is formed to be asymmetrical with respect to a center line that passes through a center in parallel with the front and back direction, since a light path of the second optical portion is corrected, the light may be emitted from the first optical portion in a direction substantially parallel with the center line, whereby an undesired beam pattern may be prevented from being formed.

Also, since the light exiting the first optical portion may be refracted by the second optical portion and then may enter the first optical portion, even in the case that the first optical portion has a slim form factor, the light efficiency may be prevented from being deteriorated.

The effects according to the embodiment of the present disclosure are not limited to those mentioned above, and more various effects are included in the following description of the present disclosure.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
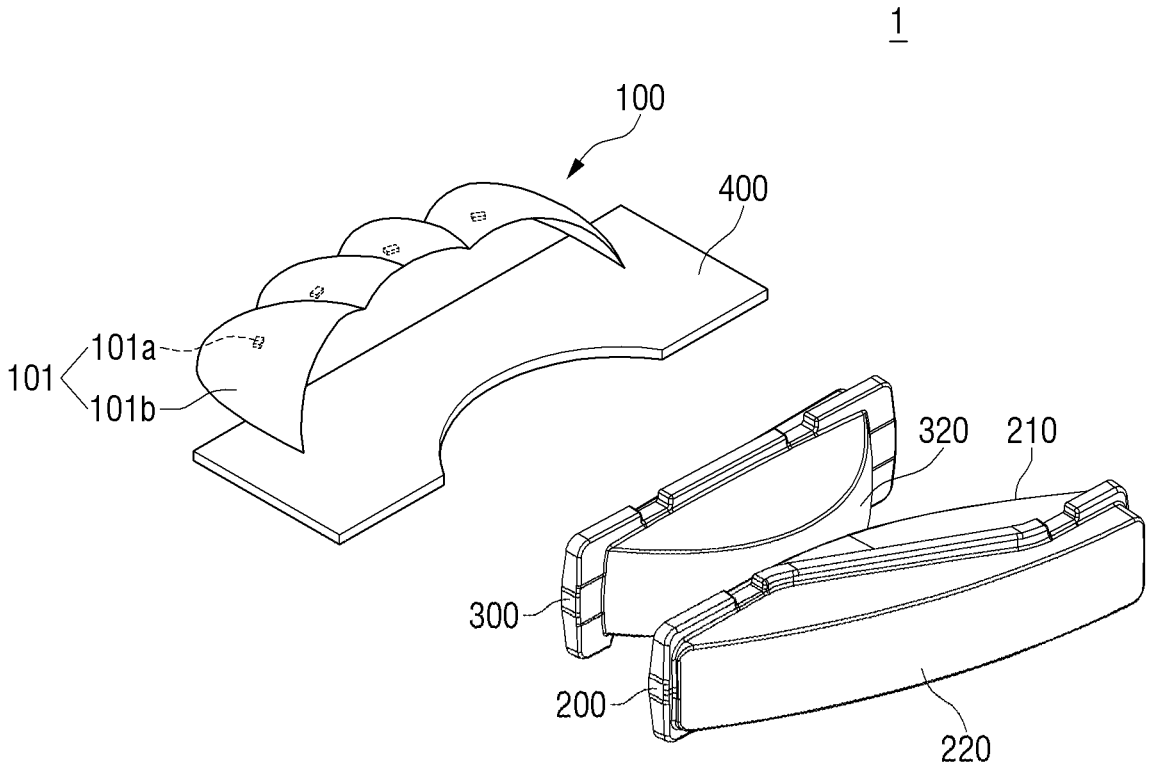
FIG. 1 is a perspective view illustrating a lamp for a vehicle according to an embodiment of the present disclosure.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Throughout the specification, like reference numerals in the drawings denote like elements.

In some embodiments, well-known steps, structures and techniques will not be described in detail to avoid obscuring the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Embodiments of the invention are described herein with reference to plan and cross-section illustrations that are schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. In the drawings, respective components may be enlarged or reduced in size for convenience of explanation.

Hereinafter, the embodiments of the present disclosure will be described with reference to the accompanying drawings illustrating a lamp for a vehicle.

Figure 2:
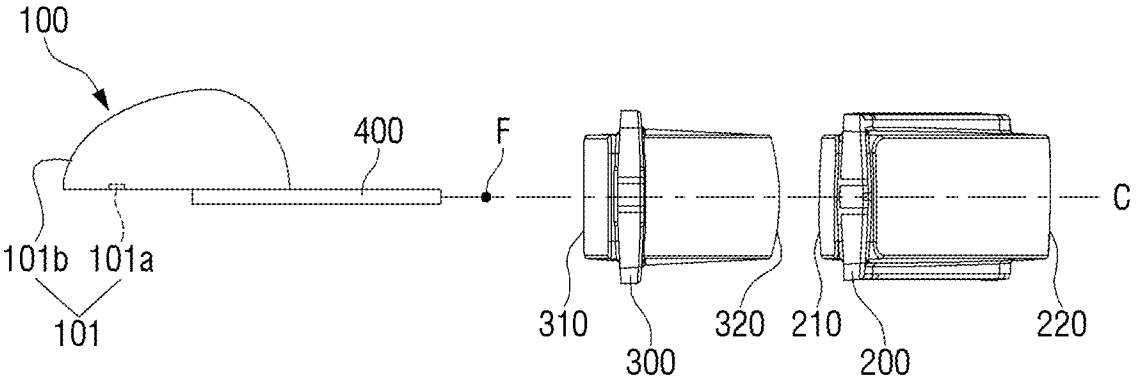
FIG. 2 is a side view illustrating a lamp for a vehicle according to an embodiment of the present disclosure.
Figure 3:
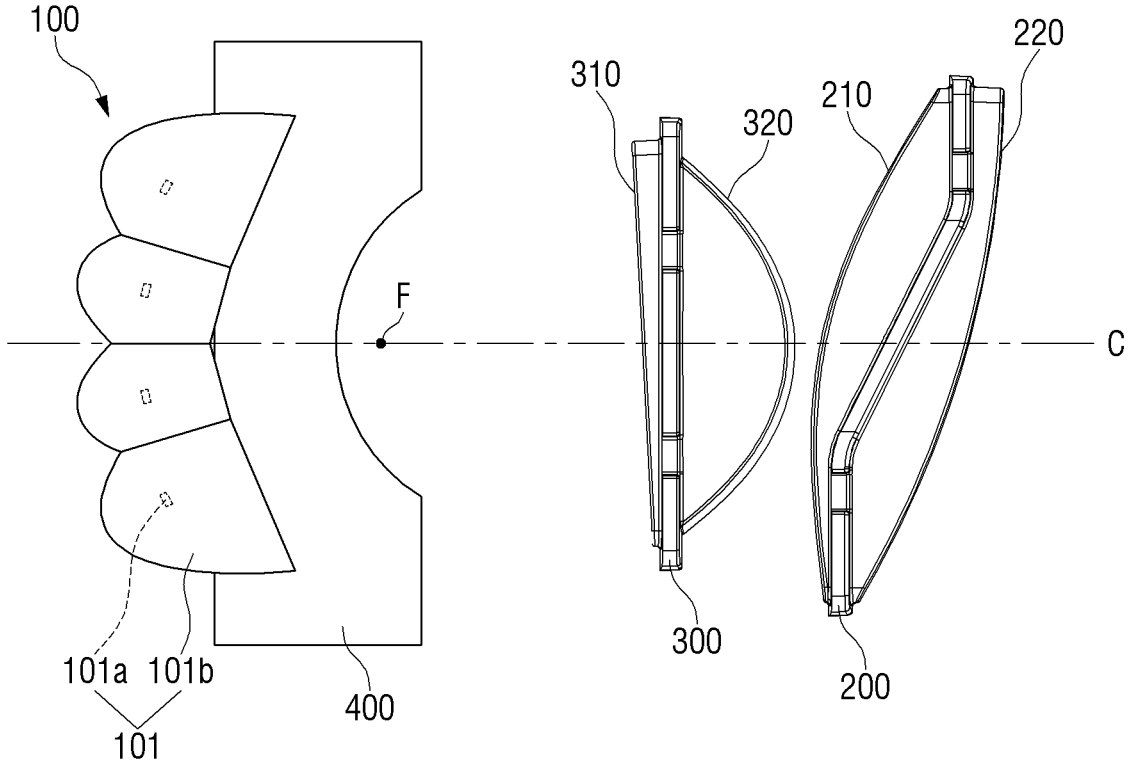
FIG. 3 is a plan view illustrating a lamp for a vehicle according to an embodiment of the present disclosure.

FIG. 1 is a perspective view illustrating a lamp for a vehicle according to an embodiment of the present disclosure, FIG. 2 is a side view illustrating a lamp for a vehicle according to an embodiment of the present disclosure, and FIG. 3 is a plan view illustrating a lamp for a vehicle according to an embodiment of the present disclosure. Referring to FIGS. 1 to 3, a lamp 1 for a vehicle according to an embodiment of the present disclosure may include a light emission portion 100, a first optical portion 200, and a second optical portion 300.

The lamp 1 for a vehicle of the present disclosure will be described based on a configuration to be used as headlamp for securing a front field of vision of a driver by irradiating light in a driving direction of the vehicle when the vehicle operates in low light conditions (e.g., at night time), but the present disclosure is not limited thereto. The lamp 1 for a vehicle of the present disclosure may be used not only as a headlamp but also as any of a variety of lamps installed in a vehicle, such as a tail lamp, a brake lamp, a fog lamp, a daytime running lamp, a turn-signal lamp, a backup lamp, and the like.

The light emission portion 100 may generate light having light amount and/or color suitable for a purpose of the lamp 1 for a vehicle of the present disclosure, and a shield portion 400 configured to shield a portion of the light generated from the light emission portion 100 may be disposed at the front of the light emission portion 100 to form a low beam pattern having a predetermined cut-off line. However, the present disclosure is not limited thereto, and the shield portion 400 may be omitted in accordance with the beam pattern formed by the lamp 1 for a vehicle of the present disclosure.

The light emission portion 100 may include a plurality of light source modules 101 arranged in a left and right direction, and in the embodiment of the present disclosure, an example where the plurality of light source modules 101 are disposed above the shield portion 400 to form a low beam pattern having a predetermined cut-off line by the light generated from the light emission portion 100 will be described by way of example. Each of the plurality of light source modules 101 may include a light source 101*a* and a reflector 101*b* that reflects the light generated from the light source 101*a* toward the forward direction.

The light source 101*a* may be disposed at a first focal point of the reflector 101*b*, and the light generated from the light source 101*a* may be reflected by the reflector 101*b* and concentrated on a second focal point in front of the reflector 101*b*. When the light emission portion 100 includes the plurality of light source modules 101, the first focal points of the plurality of light source modules 101 may be formed at their respective positions that are different from one another, and the second focal points thereof may be formed at a same position. Hereinafter, in the embodiment of the present disclosure, a second focal point of the reflector 101*b* will be referred to as a focal point F of the light emission portion 100.

In particular, in the embodiment of the present disclosure, the case that the light generated from the light source 101*a* is reflected toward the front by the reflector 101*b* will be described by way of example. However, the present disclosure is not limited to such a configuration, and not only the reflector 101*b* but also various types of optical elements, such as a mirror or prism, which allow the light generated from the light source 101*a* to move toward the front, may be used.

Further, in the embodiment of the present disclosure, the case that the light emission portion 100 includes four light source modules 101 arranged in a left and right direction will be described by way of example. However, this configuration is merely exemplary to assist understanding of the present disclosure. The present disclosure is not limited thereto, and various modifications may be made in the number, arrangement direction, position, or the like of the light source modules included in the light emission portion 100, depending on light distribution characteristics such as size, shape and brightness of the beam pattern formed by the lamp 1 for a vehicle of the present disclosure.

When the light emission portion 100 includes the plurality of light source modules 101, the plurality of light source modules 101 may respectively form different regions of the low beam pattern. For example, any one of the plurality of light source modules 101 may form a high illumination region of the low beam pattern and another one of the plurality of light source modules 101 may form a spread region of the low beam pattern. Any one of the plurality of light source modules 101 may be positioned to be tilted at a predetermined angle with respect to the another depending on the region formed in each of the plurality of light source modules 101.

The first optical portion 200 may be disposed in front of the light emission portion 100 such that incident light may be emitted from the light emission portion 100 to form a beam pattern suitable for the purpose of the lamp 1 for a vehicle of the present disclosure. The first optical portion 200 may include a first incident surface 210 and a first emission surface 220, and the light irradiated from the lamp 1 for a vehicle of the present disclosure may be understood as the light emitted from the first emission surface 220.

In order that the beam pattern suitable for the purpose of the lamp 1 for a vehicle of the present disclosure is formed by the light emitted from the first emission surface 220, the first emission surface 220 may be required to be positioned at the outermost part of the vehicle. In this case, the first emission surface 220 may form a portion of a contour of the vehicle exterior.

The first emission surface 220 may be formed such that both sides thereof are symmetrical to each other with respect to a center line C that passes through the center of the first optical portion 200 in parallel with a forward and backward direction, depending on the contour of the vehicle exterior, or may be formed such that both sides thereof are asymmetrical to each other along at least one direction with respect to the center line C. In the examples shown in FIGS. 1 to 3, both sides of the first emission surface 220 are formed to be symmetrical to each other in an up and down direction with respect to the center line C and formed to be asymmetrical to each other in a left and right direction.

In particular, the case that both sides of the first emission surface 220 are formed to be asymmetrical to each other along at least one direction with respect to the center line C may be understood that both sides are different from each other in at least one of their forming angles, curvatures, or sizes (lengths) with respect to the center line C.

Figure 4:
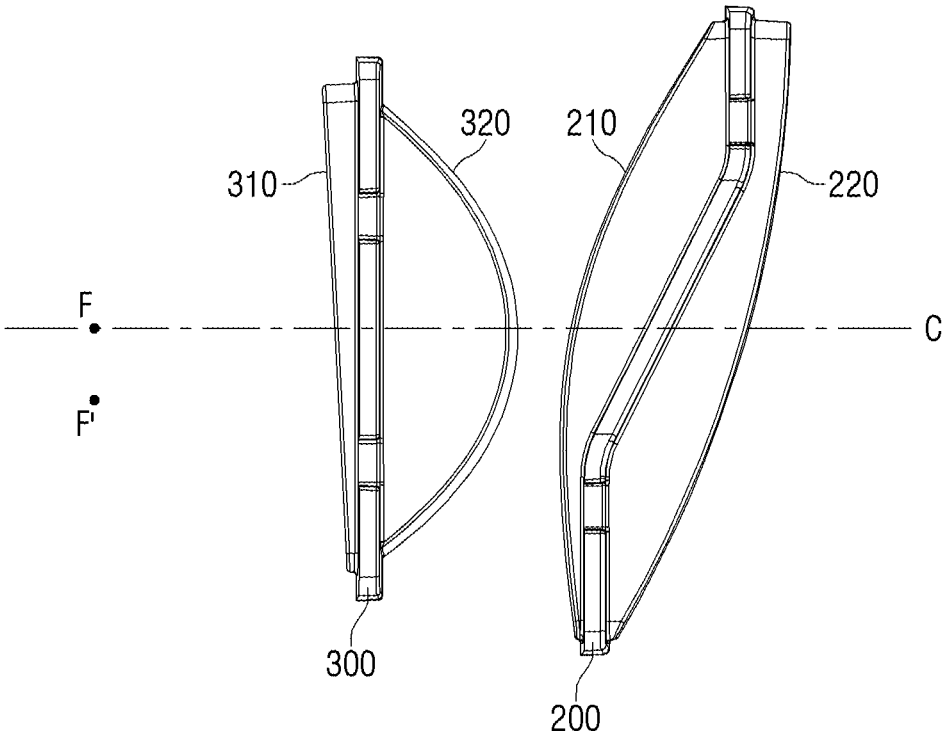
FIG. 4 is a schematic view illustrating a focal point of a light emission portion and a rear focal point of a first optical portion according to an embodiment of the present disclosure.

Accordingly, when both sides of the first emission surface 220 are formed to be asymmetrical to each other along at least one direction with respect to the center line C, a rear focal point F' of the first optical portion 200 may be formed at a position different from that of the focal point F of the light emission portion 100 as shown in FIG. 4. In this case, the rear focal point F' of the first optical portion 200 may be formed to be spaced apart from the center line C by a predetermined interval in one side direction and thus at least a portion of incident light from the light emission portion 100 may be emitted to be titled at a predetermined angle with respect to the center line C, whereby an undesired beam pattern may be formed.

In other words, the light emission portion 100 may be generally designed to concentrate light on the rear focal point of the first optical portion 200 when both sides of the first optical portion 200 are formed to be symmetrical to each other with respect to the center line C. However, when both sides of the first emission surface 220 are formed to be asymmetrical to each other along at least one direction with respect to the center line C, the position of the rear focal point of the first optical portion 200 may be varied, whereby the position on which the light generated from the light emission portion 100 is concentrated and the rear focal point of the first optical portion 200 may become different from each other. In this case, at least a portion of the light emitted from the first emission surface 220 may be titled at a predetermined angle with respect to the center line C.

For example, when the lamp 1 for a vehicle of the present disclosure is used as a headlamp, the light irradiated from the lamp 1 for a vehicle of the present disclosure may need to be irradiated toward the front of the vehicle. However, when both sides of the first emission surface 220 are formed to be asymmetrical to each other along at least one direction with respect to the center line C in order to correspond to the contour of the vehicle exterior, the light emitted from the first emission surface 220 may not be parallel with the center line C. Accordingly, it may be difficult to form a beam pattern that is suitable for the headlamp.

In other words, when the first emission surface 220 has an aspherical shape of which both sides are symmetrical to each other with respect to the center line C, incident light that transmits from the light emission portion 100 through the rear focal point of the first optical portion 200 may be emitted in a direction parallel with the center line C through the first emission surface 220. On the other hand, when both sides of the first emission surface 220 are asymmetrical to each other along at least one direction with respect to the center line C, the position on which the light generated from the light emission portion 100 is concentrated and the rear focal point of the first optical portion 200 may become different from each other. As a result, at least a portion of the light emitted from the first optical portion 200 may be titled by some angle in at least one direction with respect to the center line C.

In the embodiment of the present disclosure, even in the case that both sides of the first emission surface 220 are formed to be asymmetrical to each other along at least one direction with respect to the center line C, a path of the light that transmits from the light emission portion 100 toward the first optical portion 200 may be corrected via a second optical portion 300 to allow the light emitted from the first emission surface 220 to be substantially parallel with the center line C.

The second optical portion 300 may include a second incident surface 310 where the light generated from the light emission portion 100 enters, and a second emission surface 320 that emits the light entering the second incident surface 310 to the first optical portion 200. In the embodiment of the present disclosure, the case that the second optical portion 300 is disposed between the focal point F of the light emission portion 100 and the first optical portion 100 will be described by way of example.

The second optical portion 300 may correct the light emitted from the first emission surface 220 to be parallel with the center line C by refracting the light in a direction different from a refractive direction of the light refracted by the first optical portion 200 even in the case that both sides of the first emission surface 220 are formed to be asymmetrical to each other in at least one direction with respect to the center line C.

In the embodiment of the present disclosure, the case that the second optical portion 300 refracts light in a direction different from the refractive direction of light refracted by the first optical portion 200 may include the case that the second optical portion 300 refracts light toward an opposite side from the refractive direction of light refracted by the first optical portion 200, the case that the second optical portion 300 refracts light toward a same side as the refractive direction of light refracted by the first optical portion 200 but has a light refractive angle different from that of the first optical portion 200, and the case that the second optical portion 300 refracts light toward an opposite side from the refractive direction of light refracted by the first optical portion 200 and has a light refractive angle different from that of the first optical portion 200.

Figure 5:
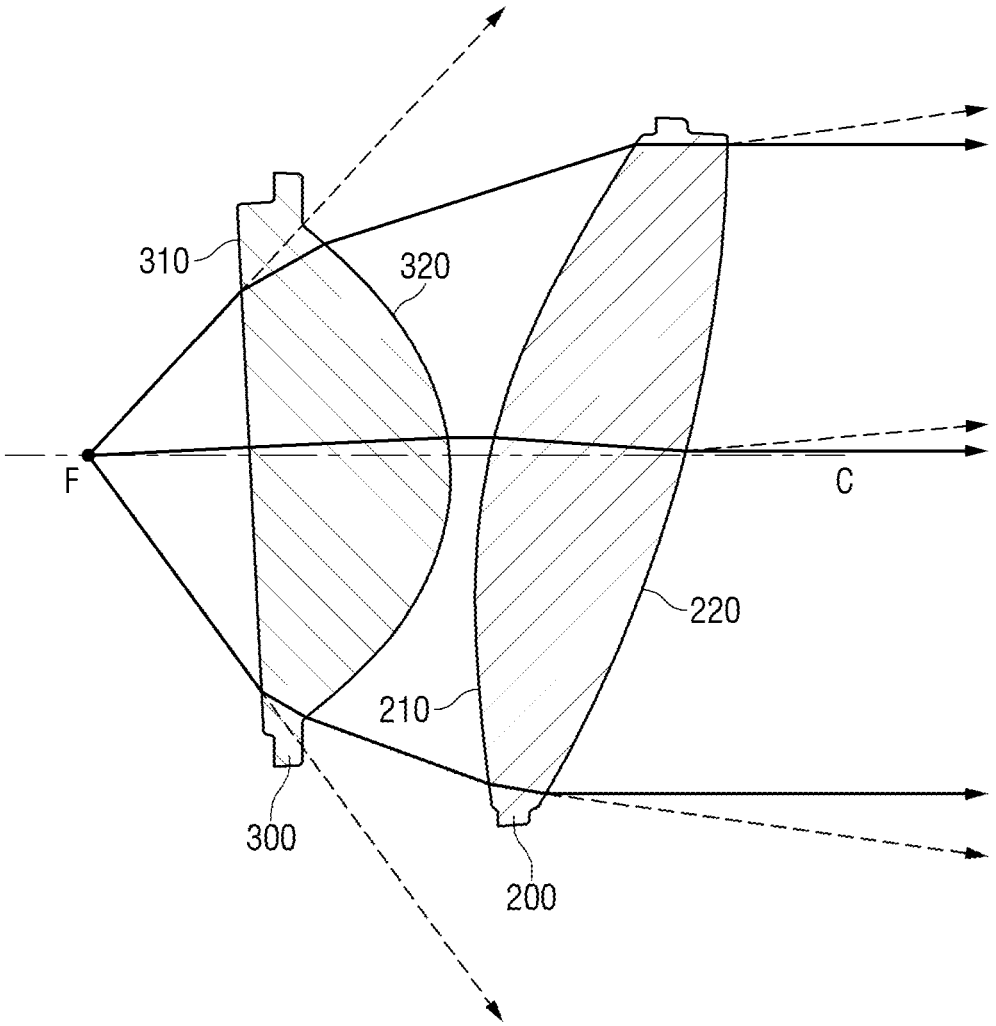
FIGS. 5 and 6 are schematic views illustrating a light path of a lamp for a vehicle according to an embodiment of the present disclosure.
Figure 6:
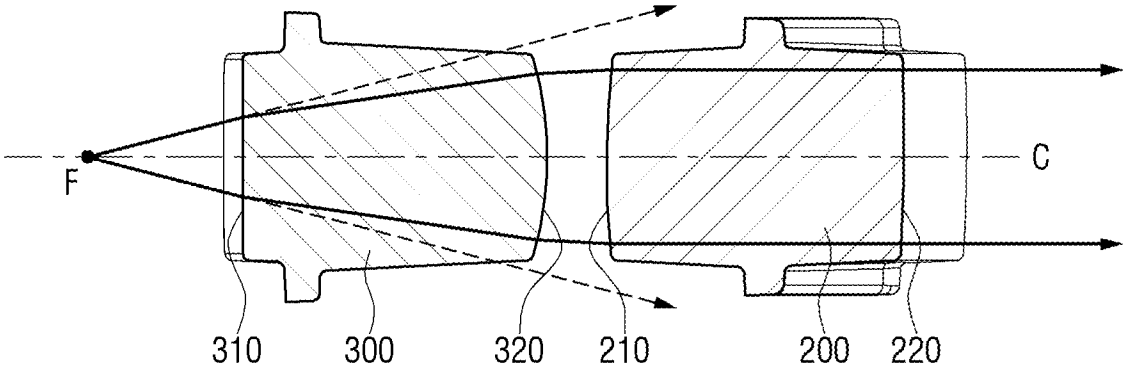

FIGS. 5 and 6 are schematic views illustrating a light path of a lamp for a vehicle according to an embodiment of the present disclosure. FIG. 5 is an example showing a light path in a left and right side, and FIG. 6 is an example showing a light path in an up and down direction.

Referring to FIG. 5, in the lamp 1 for a vehicle according to the embodiment of the present disclosure, when the light generated from the light emission portion 100 directly enters the first optical portion 200, since both sides of the first emission surface 220 are formed to be asymmetrical to each other along the left and right direction with respect to the center line C, at least a portion of the light emitted from the first emission surface 220 may be tilted at a predetermined angle in the left and right direction with respect to the centerline C as shown in broken lines. On the other hand, when the light path is adjusted by the second optical portion 300 before the light generated from the light emission portion 100 enters the first optical portion 200, the light that enters the first optical portion 200 may be emitted to be parallel with the center line C.

In the embodiment of the present disclosure, the case that the first emission surface 220 has a curved shape in which a second end disposed at an outer side of the vehicle is closer to the light emission portion 100 than a first end disposed at an inner side of the vehicle in the left and right direction will be described by way of example. In this case, both sides of each of the first incident surface 210, the second incident surface 310, and the second emission surface 320 may be formed to be asymmetrical to each other in a left and right direction with respect to the center line C such that the light emitted from the first emission surface 220 is parallel with the center line C.

For example, when the first incident surface 210 has a curved shape in which the second end that is disposed at the outer side of the vehicle is closer to the light emission portion 100 than the first end that is disposed at the inner side of the vehicle in the left and right direction, the second incident surface 310 may have a planar shape in which a first end that is disposed at the inner side of the vehicle is closer to the light emission portion 100 than a second end that is disposed at the outer side of the vehicle in the left and right direction, and the second emission surface 320 may have a shape in which the second side disposed at the outer side of the vehicle has a curvature greater than that of the first side disposed at the inner sider of the vehicle with respect to the center line C, whereby the light emitted from the first emission surface 220 may proceed in substantially parallel with the center line C even in the case that the first emission surface 220 is formed to be asymmetrical in the left and right direction with respect to the center line C.

Referring to FIG. 6, it is noted that both sides of the first emission surface 220 are formed to be symmetrical to each other in an up and down direction with respect to the center line C. In this case, the first incident surface 210, the second incident surface 310, and the second emission surface 320 may be formed such that their respective both sides are symmetrical to each other in the up and down direction with respect to the center line C. In particular, in FIGS. 5 and 6, F may be understood as a point on which the light generated from the light emission portion 100 is concentrated, that is, a focal point F of the light emission portion 100, when both sides of the first optical portion 100 are formed to be symmetrical to each other with respect to the center line C.

In the embodiment of the present disclosure, the case that both sides of the first emission surface 220 are formed to be asymmetrical to each other along at least one direction with respect to the center line C and the case that both sides of each of the first incident surface 210, the second incident surface 310, and the second emission surface 320 are formed to be asymmetrical to each other along at least one direction with respect to the center line C have been described as examples. However, the present disclosure is not limited to these examples, based on the shape of the first emission surface 220, both sides of at least one of the first incident surface 210, the second incident surface 310, or the second emission surface 320 may be formed to be asymmetrical to each other along at least one direction with respect to the center line C.

Further, even in the case that both sides of the first emission surface 220 are formed to be symmetrical to each other with respect to the center line C, both sides of at least one of the first incident surface 210, the second incident surface 310, or the second emission surface 320 may be formed to be asymmetrical to each other along at least one direction with respect to the center line C such that the light may be emitted from the first emission surface 220 substantially in parallel with the center line C.

Meanwhile, in addition to allowing the light emitted from the first emission surface 220 to be parallel with the center line C, the second optical portion 300 may also allow light that would otherwise proceed with an angle wider than the first optical portion 200, among the light beams generated from the light emission portion 100, to be bent and incident on the first optical portion 200, thereby improving light efficiency.

In other words, as shown in FIGS. 5 and 6, the second optical portion 300 may adjust a light path such that the light moving toward the direction that would be outside of the first optical portion 200 among the lights generated from the light emission portion 100 may enter the first optical portion 200. Accordingly, the light efficiency may be improved, whereby a beam pattern of sufficient brightness may be formed even in the case that the second optical portion 300 has a slim form factor.

For example, when the first optical portion 200 has a slim form factor (i.e., a form factor that extends in the left and right direction and where the horizontal width is substantially greater than the vertical height), the amount of light entering the first optical portion 200 may be relatively reduced. As such, in order that the beam pattern of sufficient brightness is formed, an electrical current applied to the light emission portion 100 may be required to be increased, which would decrease the light efficiency. However, in the embodiment of the present disclosure, since the light that proceeds toward the direction outside of the first optical portion 200 among the lights generated from the light emission portion 100 may enter the first optical portion 200 due to the second optical portion 300, the beam pattern of sufficient brightness may be formed without increasing the electrical current applied to the light emission portion 100, whereby power consumption may be prevented from being increased.

In the lamp 1 for a vehicle of the present disclosure, a portion of the light generated from the light emission portion 100 may be shielded by the shield portion 400, and at least a portion of the light shielded by the shield portion 400 may be reflected toward the front such that the light efficiency may be prevented from being deteriorated due to the light shielded by the shield portion 400.

Figure 7:
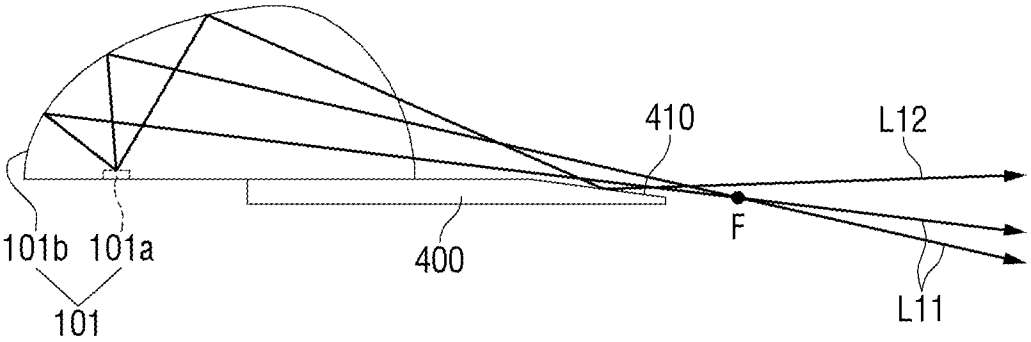
FIG. 7 is a schematic view illustrating a light path based on a shield portion according to an embodiment of the present disclosure.

FIG. 7 is a sectional view showing a shield portion according to the embodiment of the present disclosure. More particularly, FIG. 7 shows an example of a light path of any one of the plurality of light source modules 101. Referring to FIG. 7, a front end of the shield portion 400 according to the embodiment of the present disclosure may be disposed at or near the focal point F of the light emission portion 100 to shield at least a portion of the light generated from the light emission portion 100, to allow a cut-off line of a low beam pattern to be formed.

In particular, the shield portion 400 may include a reflective surface 410 formed on at least a portion of a surface by which a portion L12 of lights L11 and L12 that are generated from the light emission portion 100 is shielded. Accordingly, the reflective surface 410 may reflect at least a portion of the light that is shielded by the shield portion 400 toward the front. By way of example, the reflective surface 410 may be formed via deposition or coating of a material, such as aluminum or chrome, which has high reflectivity.

The reflective surface 410 may be formed such that its rear end may be spaced apart from the center line C farther than its front end. Accordingly, at least a portion L12 of the lights shielded by the shield portion 400 may be reflected toward the front by the reflective surface 410. In the embodiment of the present disclosure, the case that the reflective surface 410 has a planar shape in which the reflective surface 410 is formed to be upwardly inclined from the front end toward the rear end will be described by way of example. However, the present disclosure is not limited to this example, and the reflective surface 410 may have a curved shape or a combined shape of the planar shape and the curved shape.

Further, in the embodiment of the present disclosure, the case that the reflective surface 410 is formed on an upper surface of the shield portion 400 such that the light shielded by the shield portion 400 is reflected on the reflective surface 410 to form a cut-off line of a low beam pattern will be described by way of example. However, the present disclosure is not limited to this example, and the reflective surface 410 may be formed on a lower surface of the shield portion 400 as well as the upper surface of the shield portion 400 depending on the beam pattern formed by the lamp 1 for a vehicle of the present disclosure.

Meanwhile, in the aforementioned embodiment, the case that the lamp 1 for a vehicle of the present disclosure forms a low beam pattern has been described by way of example. However, the present disclosure is not limited to this example, and the lamp 1 for a vehicle of the present disclosure may form a plurality of different beam patterns.

Figure 8:
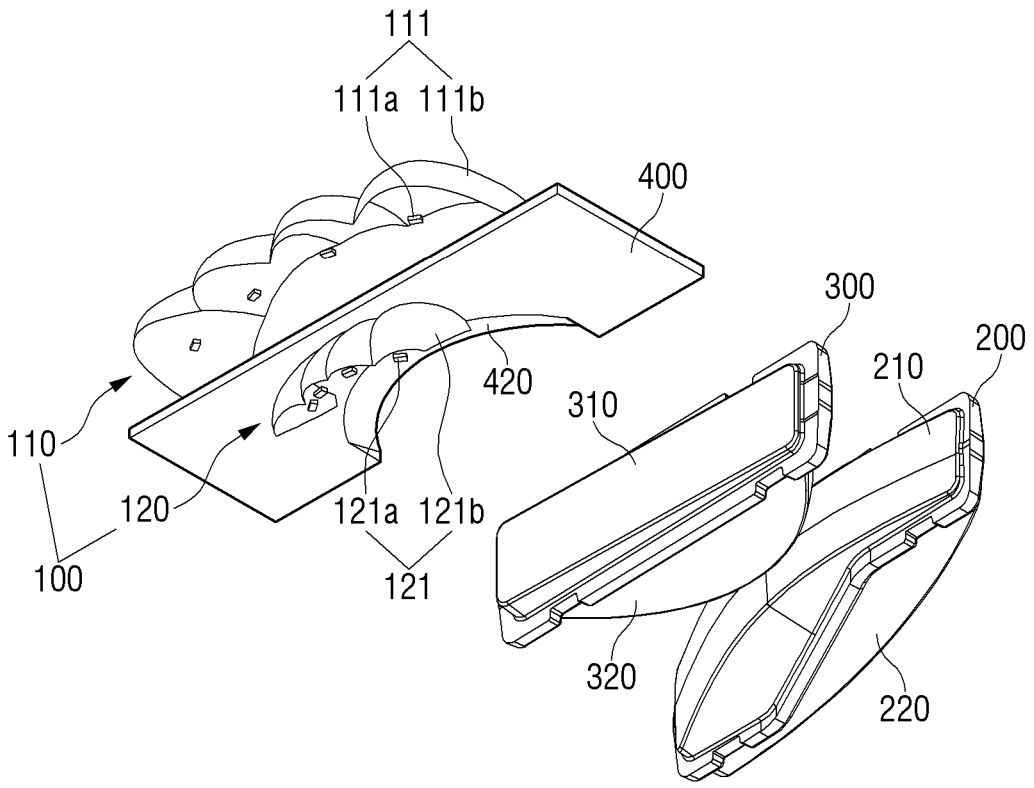
FIG. 8 is a perspective view illustrating a lamp for a vehicle according to another embodiment of the present disclosure.
Figure 9:
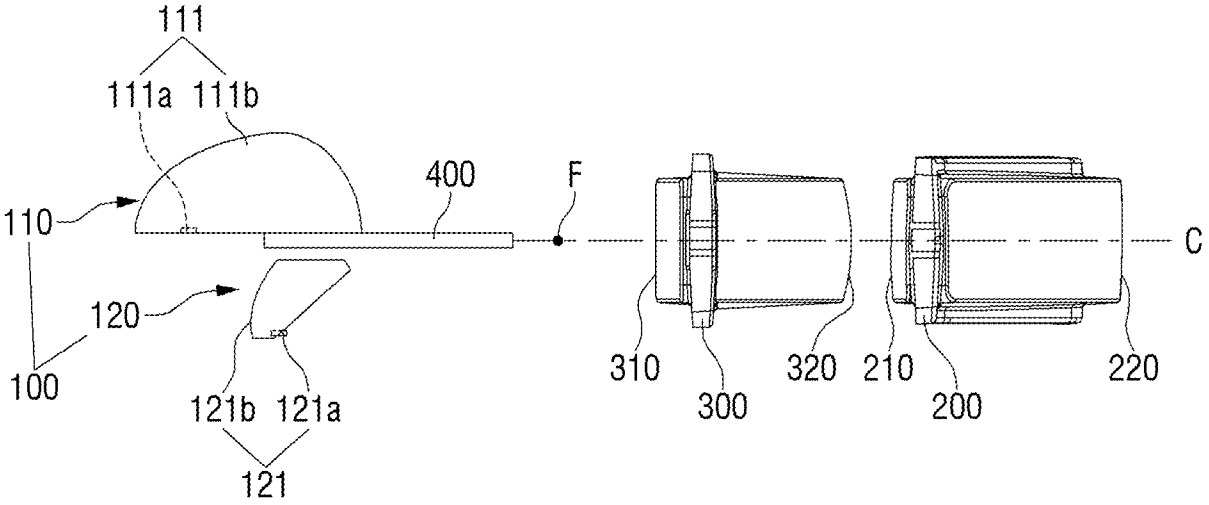
FIG. 9 is a side view illustrating a lamp for a vehicle according to another embodiment of the present disclosure.

FIG. 8 is a perspective view illustrating a lamp for a vehicle according to another embodiment of the present disclosure, and FIG. 9 is a side view illustrating a lamp for a vehicle according to another embodiment of the present disclosure. Referring to FIGS. 8 and 9, the lamp 1 for a vehicle according to another embodiment of the present disclosure may include a light emission portion 100, a first optical portion 200, and a second optical portion 200. In another embodiment of the present disclosure, the same reference numerals will be used for the same or similar elements as those of the aforementioned embodiment, and their detailed description will be omitted.

In another embodiment of the present disclosure, the light emission portion 110 may include a first light source portion 110 disposed above the shield portion 400, and a second light source portion 120 disposed below the shield portion 400. The first light source portion 110 may include a plurality of light source modules 111, each of which includes a light source 111*a* and a reflector 111*b*, and the second light source portion 120 may include a plurality of light source modules 121, each of which includes a light source 121*a* and a reflector 121*b*. The plurality of light source modules 111 of the first light source portion 110 and the plurality of light source modules 121 of the second light source portion 120 may be arranged in a left and right direction.

The first light source portion 110 may generate a first light beam for forming a first beam pattern, and the second light source portion 120 may generate a second light beam for forming a second beam pattern. In another embodiment of the present disclosure, the case that the first light source portion 110 and the second light source portion 120 respectively include the plurality of light source modules 111 and 121 arranged in the left and right direction will be described by way of example. However, this configuration is only an example to assist understanding of the present disclosure, and the present disclosure is not limited thereto. The number and arrangement direction of the light source modules included in each of the first light source portion 110 and the second light source portion 120 may be varied depending on light distribution characteristics of the beam pattern formed by the lamp 1 for a vehicle of the present disclosure.

In another embodiment of the present disclosure, the case that the first light source portion 110 forms a low beam pattern as the first beam pattern, and the second light source portion 120 forms a high beam pattern as the second beam pattern will be described by way of example. The second light source portion 120 may be illuminated together with the first light source portion 110 to ensure a wide viewing range and a long viewing distance in front of the vehicle.

Figure 10:
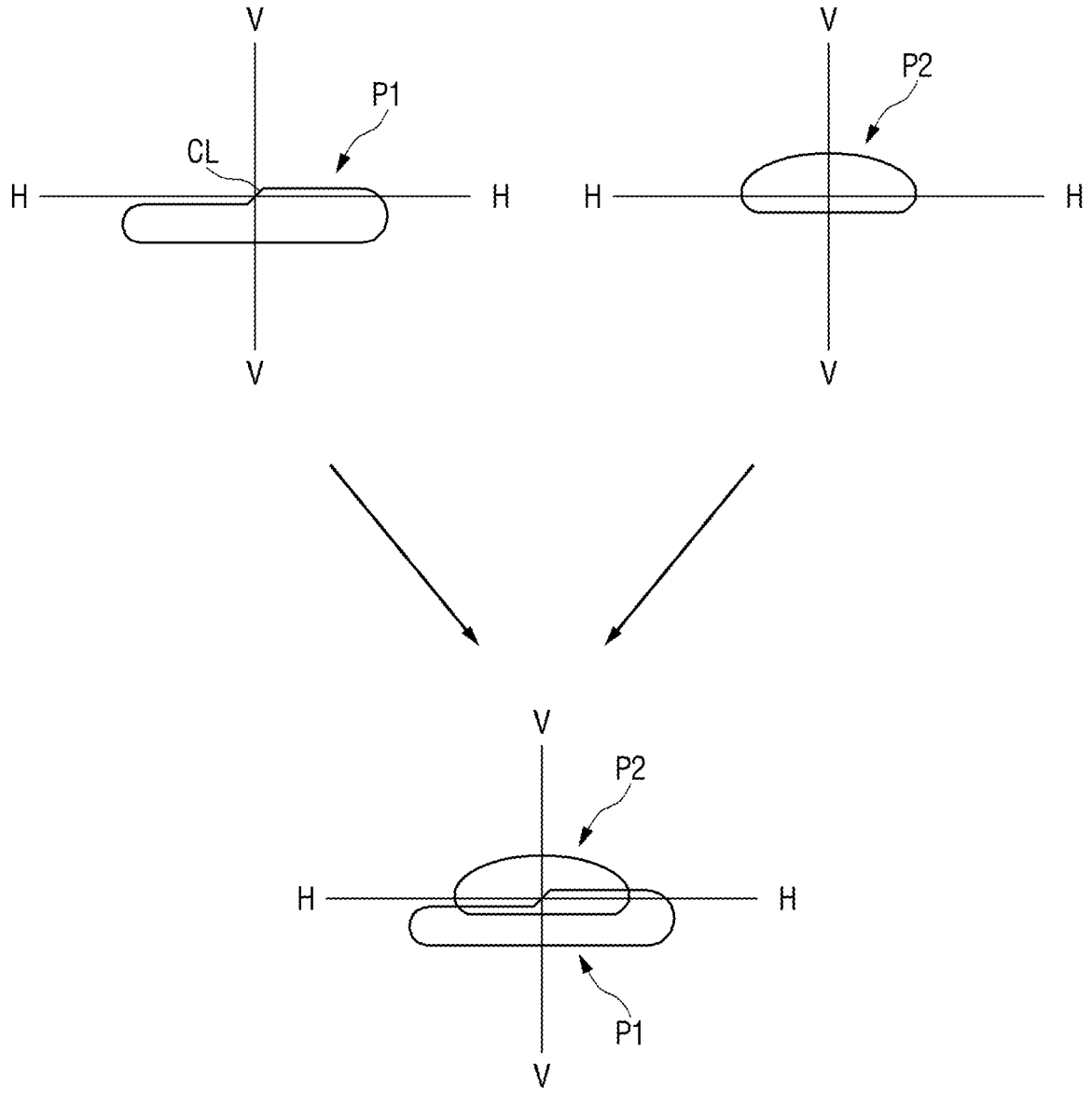
FIG. 10 is a schematic view illustrating a beam pattern formed by a lamp for a vehicle according to another embodiment of the present disclosure.

FIG. 10 is a schematic view illustrating a beam pattern formed by a lamp for a vehicle according to another embodiment of the present disclosure. Referring to FIG. 10, in the lamp 1 for a vehicle according to another embodiment of the present disclosure, a portion of the light generated from at least one of the first light source portion 110 and the second light source portion 120 may be shielded by the shield portion 400 such that an upper boundary of a low beam pattern P1, that is, a cut-off line CL is formed, and a lower boundary of a high beam pattern P2 is formed. In this case, however, there may be a concern that the light efficiency may be deteriorated due to the light shielded by the shield portion 400.

In another embodiment of the present disclosure, to prevent the light efficiency from deteriorating due to the light shielded by the shield portion 400, at least a portion of the light shielded by the shield portion 400 may be configured to be reflected toward the front.

Figure 11:
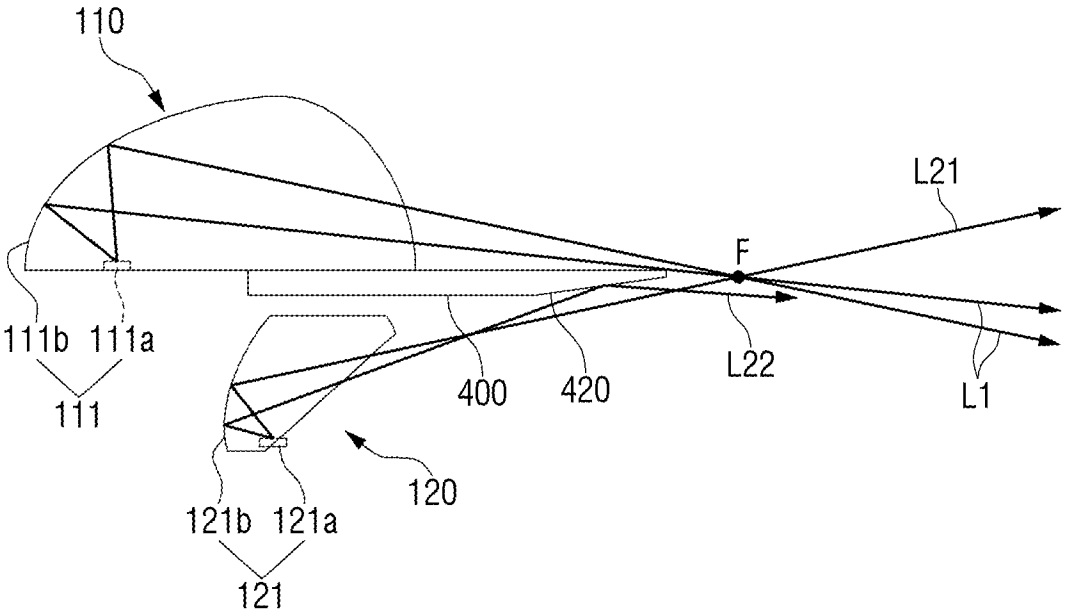
FIG. 11 is a schematic view illustrating a light path based on a shield portion according to another embodiment of the present disclosure.

FIG. 11 is a schematic view illustrating a shield portion according to another embodiment of the present disclosure. Referring to FIG. 11, the shield portion 400 according to another embodiment of the present disclosure may include a reflective surface 420, formed on a lower surface, to reflect at least a portion of the light generated from the second light source portion 120 toward the front.

In another embodiment of the present disclosure, the reflective surface 420 may reflect the shielded light among the lights generated from the second light source portion 120 toward the front. Similar to the reflective surface 410 of the aforementioned embodiment, the reflective surface 420 may have a planar shape, a curved shape, or a combination thereof, in which its rear end is spaced apart farther from the center line C than its front end.

As described above, when the reflective surface 420 is formed on the lower surface of the shield portion 400, a portion L1 of the lights generated from the first light source portion 110 may bypass the shield portion 400, and the portion L22 that would otherwise be shielded by the shield portion 400 may be reflected toward the front by the reflective surface 420, whereby the light efficiency may be improved even though the second optical portion 200 has a slim form factor.

In another embodiment of the present disclosure, the case that the reflective surface 420 is formed on the lower surface of the shield portion 400 has been described by way of example. However, the present disclosure is not limited to this example, the reflective surface 410 may be formed on the upper surface of the shield portion 400 similarly to the aforementioned embodiment.

In concluding the detailed description, those skilled in the art will appreciate that many variations and modifications can be made to the exemplary embodiments without substantially departing from the principles of the present invention. Therefore, the disclosed preferred embodiments of the invention are used in a generic and descriptive sense only and not for purposes of limitation.

What is claimed is:

1. A lamp for a vehicle, comprising:

a light emission portion to generate light;

a first optical portion disposed in front of the light emission portion to allow the light generated from the light emission portion to be incident thereto; and a second optical portion disposed between the light emission portion and the first optical portion, wherein the second optical portion bends an overall light axis of the light in a first direction, wherein the first optical portion is tilted with respect to the second optical portion to allow the overall light axis of the light to bend in a second direction, which is different from the first direction, wherein both sides of an emission surface of the first optical portion are formed to be asymmetrical to each other along at least one direction with respect to a center line that passes through a center of the first optical portion in a front and back direction, and wherein a rear focal point of the first optical portion is formed at a position spaced apart from the center line by a predetermined interval.

2. The lamp for a vehicle of claim 1, wherein both the first direction and the second direction are toward a same side.

3. The lamp for a vehicle of claim 1, wherein the first direction and the second direction are toward opposite sides.

4. The lamp for a vehicle of claim 1, wherein the second optical portion refracts the light at a refractive angle different from a refractive angle of the first optical portion.

5. The lamp for a vehicle of claim 1, wherein an emission surface of the first optical portion forms a portion of a contour of an exterior of the vehicle.

6. The lamp for a vehicle of claim 1, wherein both sides of at least one of an incident surface of the first optical portion, an incident surface of the second optical portion, or an emission surface of the second optical portion are formed to be asymmetrical to each other along at least one direction with respect to the center line to allow the light to be emitted from the first optical portion in a direction substantially parallel with the center line.

7. The lamp for a vehicle of claim 1, wherein both sides of at least one of an incident surface of the first optical portion, an incident surface of the second optical portion, or an emission surface of the second optical portion are different from one another in terms of at least one of their forming angles or curvatures along at least one direction with respect to the center line.

8. The lamp for a vehicle of claim 1, wherein the second optical portion allows the light that is directed to outside of the incident surface of the first optical portion to be refracted and incident to the incident surface of the first optical portion.

9. The lamp for a vehicle of claim 1, further comprising:

a shield portion configured to shield at least a portion of the light proceeding from the light emission portion to the second optical portion.

10. The lamp for a vehicle of claim 9, wherein the shield portion includes a reflective surface formed on a surface for shielding at least a portion of the light generated from the light emission portion to reflect the shielded light toward the first optical portion.

11. The lamp for a vehicle of claim 10, wherein the reflective surface is formed such that a rear end thereof is spaced apart farther from a center line that passes through a center of the first optical portion than a front end thereof.

12. The lamp for a vehicle of claim 9, wherein the light emission portion comprises:

a first light source portion disposed above the shield portion; and a second light source portion disposed below the shield portion, wherein a reflective surface for reflecting at least a portion of the light shielded by the shield portion toward the first optical portion is formed on at least one of an upper surface or a lower surface of the shield portion.

13. A lamp for a vehicle, comprising:

a light generating portion that generates light;

a light emitting portion that is disposed in front of the light generating portion to allow the light generated from the light generating portion to be emitted through the light emitting portion; and an optical portion disposed between the light generating portion and the light emitting portion, wherein an emission surface of the optical portion has an asymmetric curvature such that a first side, which is disposed at a laterally inner side of the vehicle, has a curvature smaller than a curvature of a second side, which is disposed at a laterally outer side of the vehicle, with respect to a center line that passes through a center of the optical portion in parallel with a forward and backward direction of the vehicle, and wherein the light emitting portion is tilted with respect to the center line to allow a laterally inner end of the light emitting portion is disposed farther from the light generating portion than a laterally outer end of the light emitting portion.

14. The lamp for a vehicle of claim 13, wherein the light emitting portion forms a part of a contour of an exterior of the vehicle.

15. A lamp for a vehicle, comprising:

a light generating portion that generates light; and an optical portion disposed on a front side of the light generating portion, the optical portion comprising a center portion and outer portions, wherein the center portion is thicker than the outer portions; and a light emitting portion disposed on a front side of the optical portion, the light emitting portion comprising a first side and a second side, wherein the light emitting portion is rotated such that the first side is closer to the light generating portion than the second side.

16. The lamp for a vehicle of claim 15, wherein the optical portion and the light emitting portion form a single focal point.

* * * * *